US007137270B2

(12) United States Patent
Lifson et al.

(10) Patent No.: US 7,137,270 B2
(45) Date of Patent: Nov. 21, 2006

(54) FLASH TANK FOR HEAT PUMP IN HEATING AND COOLING MODES OF OPERATION

(75) Inventors: Alexander Lifson, Manlius, NY (US); Michael F. Taras, Fayetteville, NY (US); Thomas J. Dobmeier, Phoenix, AZ (US)

(73) Assignee: Carrier Corporation, Syracuse, NY (US)

( * ) Notice: Subject to any disclaimer, the term of this patent is extended or adjusted under 35 U.S.C. 154(b) by 78 days.

(21) Appl. No.: 10/891,391

(22) Filed: Jul. 14, 2004

(65) Prior Publication Data

US 2006/0010899 A1 Jan. 19, 2006

(51) Int. Cl.
*F25B 13/00* (2006.01)

(52) U.S. Cl. ..... 62/324.1; 62/196.4

(58) Field of Classification Search ..... 62/324, 62/196.4, 225, 505, 509, 512, 513, 518, 324.1
See application file for complete search history.

(56) References Cited

U.S. PATENT DOCUMENTS 4,899,555 A * 2/1990 Shaw ..... 62/505
5,465,586 A * 11/1995 Sjoholm et al. ..... 62/84
6,374,631 B1 * 4/2002 Lifson et al. ..... 62/505
6,474,087 B1 * 11/2002 Lifson ..... 62/199
6,655,172 B1 * 12/2003 Perevozchikov et al. ..... 62/505

* cited by examiner

*Primary Examiner*—Melvin Jones
(74) *Attorney, Agent, or Firm*—Carlson, Gaskey & Olds

(57) ABSTRACT

A heat pump design with an economizer flash tank provides an efficient way to operate the system in both heating and cooling modes. Various expansion device types can be employed with this design. The invention enhances system performance in both cooling and heating modes of operation, through utilization of the flash tank economizer cycle, in simplistic and cost effective manner, while sustaining expansion device and entire system functionality through an appropriate refrigerant rerouting around the compressor and the flash tank.

13 Claims, 2 Drawing Sheets

FLASH TANK FOR HEAT PUMP IN HEATING AND COOLING MODES OF OPERATION

BACKGROUND OF THE INVENTION

This invention relates to the use of a flash tank in an economizer cycle for a heat pump unit that is operable in both heating and cooling modes.

Usually, refrigerant heat pump systems provide cooled air in an air conditioning (cooling) mode and heated air in a heat pump (heating) mode. Essentially, the refrigerant flow through the system heat exchangers is reversed to provide the two distinct modes of operation.

One modern development in refrigerant cycles is the inclusion of a flash tank economizer cycle. In a flash tank economizer cycle refrigerant is partially expanded in the first expansion device downstream of a condenser, which is an outdoor heat exchanger in a cooling mode or an indoor heat exchanger in a heating mode, to some intermediate pressure and temperature and delivered to a flash tank, usually in a two-phase thermodynamic state. In a flash tank, which essentially is a refrigerant container, the refrigerant phase separation occurs. Refrigerant vapor is directed to an intermediate pressure port of the compressor (or in between the compressor stages, if the multi-stage compression is utilized) and refrigerant liquid is expanded once again in a second expansion device to the evaporation pressure (which is about equal to the pressure at the compressor suction port). The flash tank essentially acts as a 100% efficient economizer heat exchanger, where liquid and vapor refrigerant temperatures are equal to each other. Thus, refrigerant delivered to an evaporator, located downstream of the second expansion device, has lower vapor quality or higher liquid content, allowing for enhanced evaporator and overall system performance.

One challenge with regard to incorporating an economizer cycle into a refrigerant system that is utilized in both heating and cooling modes of operation is that distinct orifice sizes may be desirable for the expansion devices in the two modes. Thus, the applicant and the inventors of this application have previously developed a system wherein a distinct orifice is presented dependent on whether heating or cooling mode is being utilized for a heat pump system incorporating an economizer heat exchanger. This invention is disclosed in co-pending U.S. patent application Ser. No. 10,693,593, now U.S. Pat. No. 6,892,553, filed 24 Oct. 2003, and entitled "Combined Expansion Device and Four-Way Reversing Valve in Economized Heat Pumps." It is desirable to provide similar arrangement for heat pump systems with the flash tank.

Another challenge for a refrigerant system designer is to reroute refrigerant flow through the system in such a way that the flash tank connection arrangement becomes independent from the position of the liquid refrigerant inlet and outlet ports and internal flash tank construction. Also, it would be desirable to provide such a schematic in a cost effective manner. Although economized heat pump systems with a flash tank are known to operate in either cooling or heating mode, it is highly desirable to extend such designs to the flash tank refrigerant systems operating in both modes to take advantages from the economized regime in both cases.

SUMMARY OF THE INVENTION

In the disclosed embodiment of this invention, an economizer heat pump system with a flash tank is operable in both heating and cooling modes. The system includes a first four-way valve for routing refrigerant from a compressor either to an indoor or outdoor heat exchanger. A second four-way valve is positioned downstream of the first four-way valve, and selectively routes refrigerant through an economizer flash tank. A first expansion device is positioned to be operable with the refrigerant being routed to the economizer flash tank. The economizer flash tank is operable to separate a vapor from a liquid, and thus essentially acts as a 100% efficient economizer heat exchanger. A second expansion device is positioned downstream of the flash tank and upstream of the evaporator. The refrigerant is routed to the flash tank in both cooling and heating modes of operation in such a way that the system schematics becomes independent from the position of the flash tank liquid refrigerant inlet and outlet ports and its internal construction.

These and other features of the present invention can be best understood from the following specification and drawings, the following of which is a brief description.

DETAILED DESCRIPTION OF THE PREFERRED EMBODIMENT

Figure 1A:
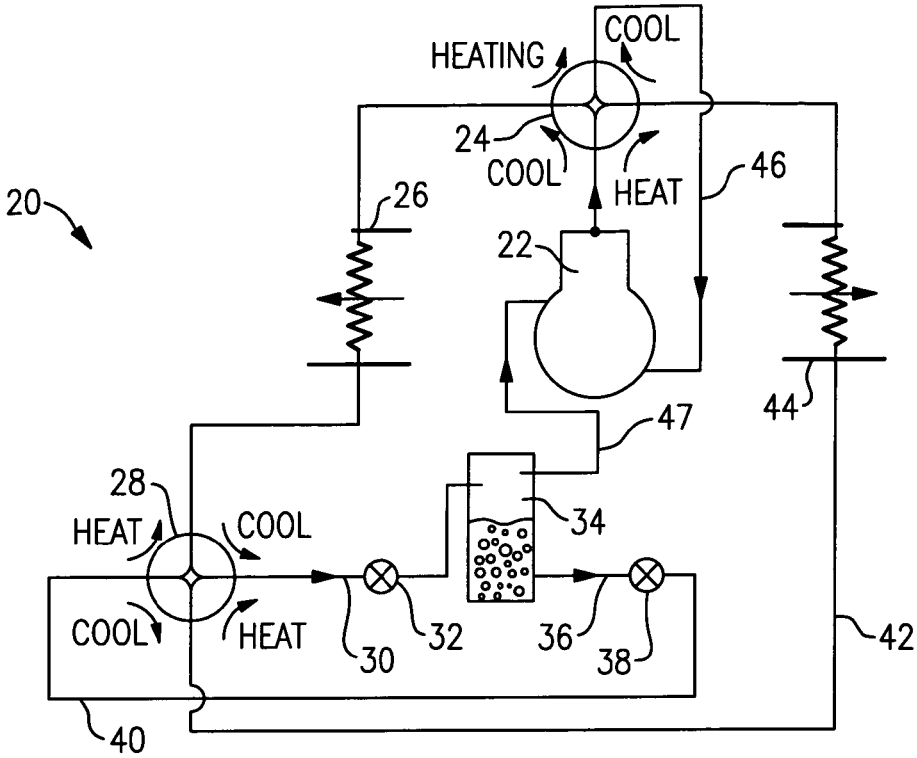
FIG. 1A shows a first schematic.

FIG. 1A illustrates a refrigerant cycle 20 incorporating compressor 22. As shown, a valve 24 selectively routes refrigerant to an outdoor heat exchanger 26, when in a cooling mode, or to an indoor heat exchanger 44, when in a heating mode. In the most typical arrangement the valve 24 is a four-way valve, though other valving arrangement can provide the identical function of re-routing the refrigerant flow around the compressor. A second four-way valve 28 is positioned downstream of the heat exchanger 26 to route the flow around the economizer flash tank 34. Again, the four-way valve is a preferred arrangement, though other valving arrangements accomplishing the re-routing of the flow around the economizer flash tank 34 can be utilized. As can be appreciated, downstream of the four-way valve 28, the refrigerant passes into a line 30, and into first expansion device 32. From the first expansion device 32, the partially expanded (to some intermediate pressure) refrigerant passes into an economizer flash tank 34. A line 36 downstream of the economizer flash tank 34 taps off the liquid refrigerant separated from a vapor within the economizer flash tank 34 and passes it through a second expansion device 38. Since the vapor has been separated in an economizer flash tank, the refrigerant that is expanded in the second expansion device 38 has higher liquid content or lower vapor quality. The higher liquid content causes enhanced evaporator and overall system performance. A line 40 downstream of the second expansion device 38 again passes through the four-way valve 28, and delivers refrigerant, usually in a two-phase thermodynamic state, to an indoor heat exchanger 44 through a line 42, when in cooling mode, or to an outdoor heat exchanger 26, when in a heating mode. A line 46 returns that refrigerant to the suction port of compressor 22, typically in a vapor state. Another line 47 returns the refrigerant vapor to an intermediate point in the compression cycle of the compressor 22.

Figure 1B:
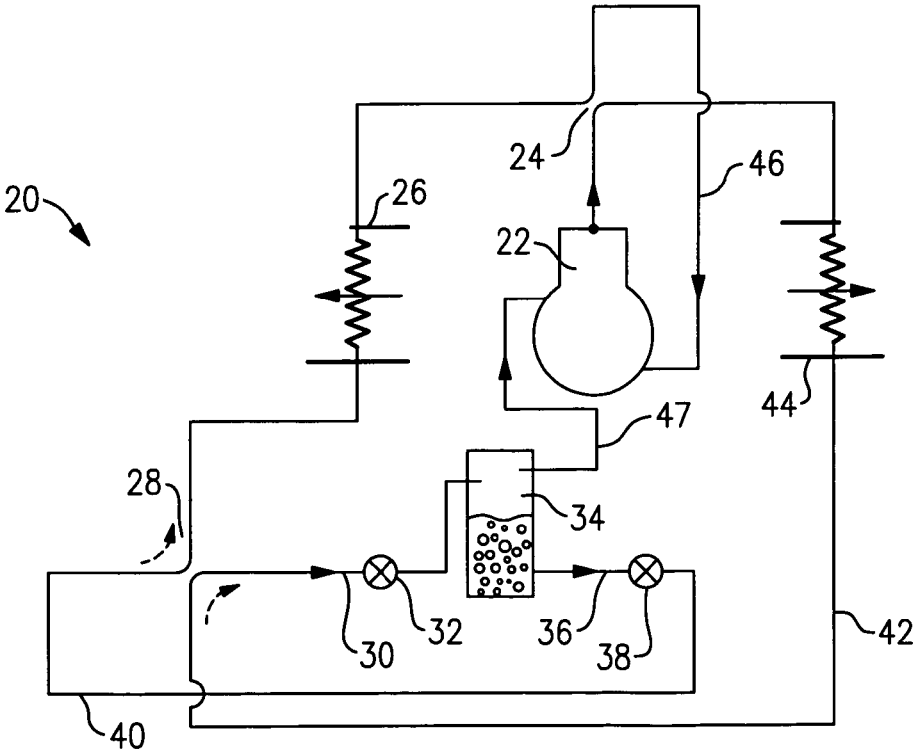
FIG. 1B shows the first schematic operating in heating mode.

As shown in FIG. 1B, the two four-way valves 24 and 28 are positioned to route the refrigerant in a heating mode.

Figure 1C:
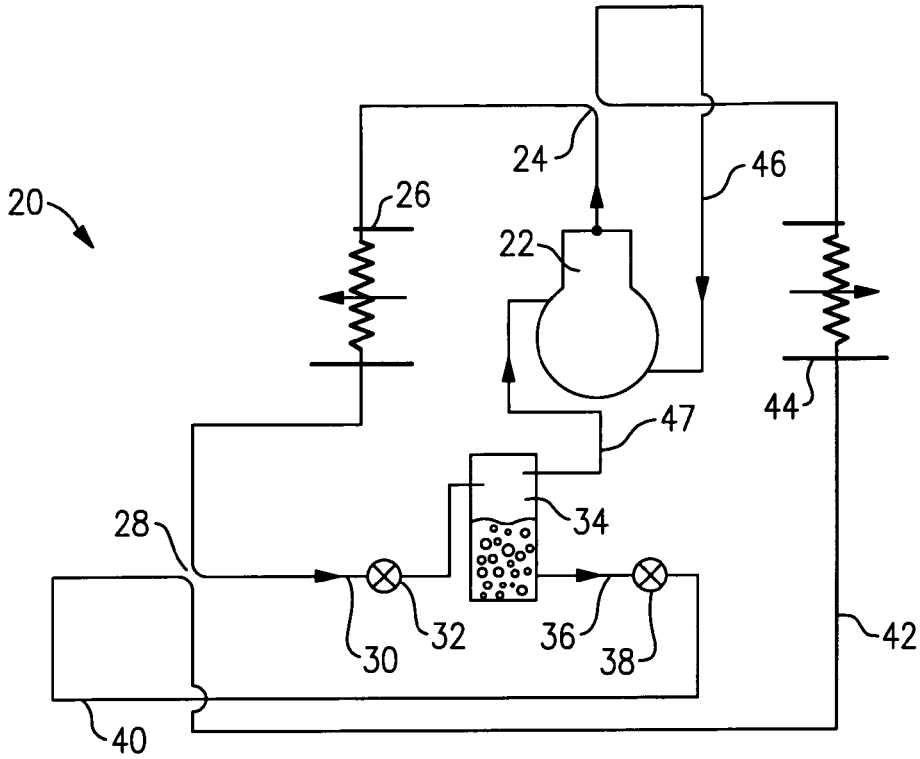
FIG. 1C shows the first schematic operating in cooling mode.

As shown in FIG. 1C, the four-way valves 24 and 28 have now been positioned to route the refrigerant in a cooling mode. As it can be seen, the expansion devices 32 and 38 are utilized in the heat pump in an identical manner, regarding the refrigerant flow direction and its thermodynamic state, in both cooling and heating modes of operation. Thus, the system schematic is transparent to the internal construction of the flash tank 34 and a relative position of the flash tank liquid inlet and outlet ports. Consequently, operation and functionality of the first (32) and second (38) expansion devices will not be compromised. It has to be noted that this system schematics can be utilized with any expansion device type, since the refrigerant flow through the system is rerouted in such a way that the functioning of the expansion devices is identical between cooling and heating modes of operation.

Figure 2:
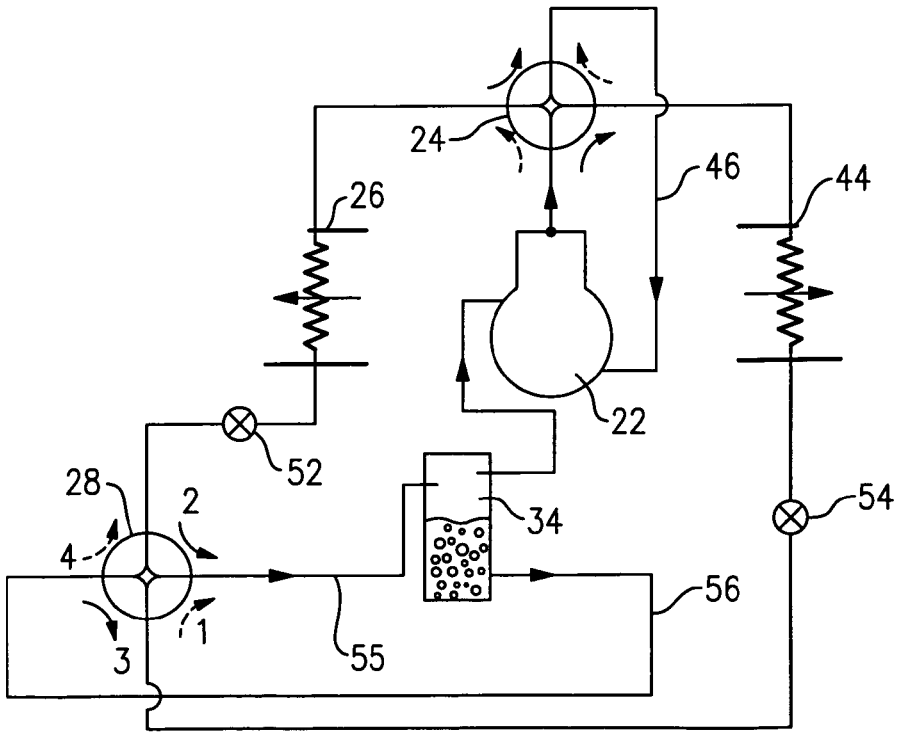
FIG. 2 shows a second schematic.

FIG. 2 shows another schematic 50 wherein the expansion devices 52 and 54 are positioned to be outwardly of the lines 55 and 56 communicated by the four-way valve 28.

The expansion device 54 will be a first expansion device, when the refrigerant system operates in a heating mode, and a second expansion device, when the system is in a cooling mode. Conversely, the expansion device 52 will be a second expansion device, when the refrigerant system operates in a heating mode, but a first expansion device, when the system is in a cooling mode.

The schematic shown on FIG. 2 takes advantage of the same benefits as schematic exhibited in FIG. 1A. Additionally, the expansion devices 52 and 54 can be sized for heating and cooling modes of operation accordingly, if desired. Lastly, this schematic is most suitable for systems incorporating electronic expansion devices or constant restriction devices, since their function can often be reversed while switching between cooling and heating modes of operation.

It should be understood that first and second expansion devices could be combined with the second four-way valve 28 for both schematics.

The present invention provides straightforward schematics of the heat pump system with an economizer flash tank that can operate in both cooling and heating modes. These schematics are independent from the internal flash tank construction and relative position of its liquid inlet and outlet ports. The system performance is enhanced in both cooling and heating modes of operation and its functionality is not compromised, while refrigerant flow is reversed between cooling and heating regimes. Further, the system is not complex and is inexpensive.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor;

an outdoor heat exchanger;

an indoor heat exchanger;

a valve assembly for selectively communicating a flow of refrigerant from said outdoor heat exchanger to an economizer flash tank in cooling mode, and said valve assembly communicating a flow of refrigerant from said indoor heat exchanger to said economizer flash tank in heating mode, and said economizer flash tank is operable to separate vapor and liquid, with said separated vapor being returned to an intermediate compression point in said compressor, and said separated liquid allowed to flow downstream to one of said indoor and outdoor heat exchangers.

2. The refrigerant system as set forth in claim 1, wherein a said valve assembly is a four-way valve.

3. The refrigerant system as set forth in claim 1, wherein a first expansion device is positioned to expand a refrigerant flow headed toward said flash tank, and a second expansion device is positioned to expand said separated liquid downstream of said flash tank.

4. The refrigerant system as set forth in claim 2, wherein a first four-way valve is positioned downstream of said compressor and serves to route said refrigerant either to said outdoor heat exchanger in cooling mode, or to said indoor heat exchanger in heating mode, and a second said four-way valve selectively routes refrigerant to said flash tank, downstream of said outdoor heat exchanger in cooling mode, or downstream of said indoor heat exchanger in heating mode.

5. The refrigerant system as set forth in claim 4, wherein said first expansion device is positioned between said second four-way valve and said flash tank, and said second expansion device is positioned to be downstream of said economizer flash tank, and upstream of a second flow path through said second four-way valve.

6. The refrigerant system as set forth in claim 4, wherein said first expansion device and said second expansion device are provided by two expansion devices which interchange their functionality between providing the first expansion device and the second expansion device as the cycle changes between heating and cooling modes.

7. The refrigerant system as set forth in claim 6, wherein said first expansion device is positioned between said second four-way valve and said economizer flash tank, to be upstream of said economizer flash tank, and said second expansion device being positioned between said second four-way valve and said economizer flash tank, and downstream of said economizer flash tank.

8. The refrigerant system as set forth in claim 6, wherein said first and second expansion devices are positioned with one expansion device between said second four-way valve and said outdoor heat exchanger, and another expansion device between said second four-way valve and said indoor heat exchanger, and with the functionality between providing the first expansion device and the second expansion device changing as the cycle changes between heating and cooling modes.

9. The refrigerant system as set forth in claim 4, wherein at least one of said expansion devices is provided within said second four-way valve.

10. The refrigerant system as set forth in claim 3, wherein at least one of said first and second expansion devices is an electronically controlled device.

11. The refrigerant system as set forth in claim 3, wherein at least one of said first and second expansion devices is a constant restriction device.

12. The refrigerant system as set forth in claim 1, wherein there is a second valve assembly for selectively communicating the flow of refrigerant downstream of said compressor either to said outdoor heat exchanger in a cooling mode, or to said indoor heat exchanger in a heating mode.

13. The refrigerant system as set forth in claim 1, wherein refrigerant passes from one of said outdoor and indoor heat exchangers back to said compressor at a suction pressure, and said intermediate compression point being at a higher pressure than a suction pressure of the suction refrigerant.

* * * * *